United States Patent [19]

Chen et al.

[11] Patent Number: 4,990,711

[45] Date of Patent: Feb. 5, 1991

[54] SYNTHETIC POLYOLEFIN LUBRICANT BLENDS HAVING HIGH VISCOSITY INDICES

[75] Inventors: Catherine S. H. Chen, Berkely Heights; Margaret M. Wu, Belle Mead, both of N.J.

[73] Assignee: Mobil Oil Corporation, New York, N.Y.

[21] Appl. No.: 210,436

[22] Filed: Jun. 23, 1988

[51] Int. Cl.[5] ..... C07C 2/08; C07C 7/00; C07C 2/10

[52] U.S. Cl. ..... 585/302; 585/329; 585/310; 585/312; 585/326

[58] Field of Search ..... 585/312, 313, 326, 329, 585/310, 302

[56] References Cited

U.S. PATENT DOCUMENTS

| | | | |
|---|---|---|---|
| 3,149,178 | 9/1964 | Hamilton et al. | 585/18 |
| 3,637,503 | 1/1972 | Giannetti | 252/59 |
| 3,795,616 | 3/1974 | Heilman et al. | 252/59 |
| 4,018,695 | 4/1977 | Heilman et al. | 252/73 |
| 4,282,392 | 8/1981 | Cupples et al. | 585/10 |
| 4,520,221 | 5/1985 | Chen | 585/517 |
| 4,547,612 | 10/1985 | Tabak | 585/329 |
| 4,568,786 | 2/1986 | Chen et al. | 585/517 |
| 4,587,368 | 5/1986 | Pratt | 585/18 |
| 4,613,712 | 9/1986 | Bridger | 585/10 |
| 4,618,737 | 10/1986 | Chester et al. | 585/329 |
| 4,650,917 | 3/1987 | Dessau et al. | 585/329 |
| 4,658,079 | 4/1987 | Chen | 585/517 |
| 4,827,064 | 5/1989 | Wu | 585/10 |
| 4,827,073 | 5/1989 | Wu | 585/530 |

OTHER PUBLICATIONS

Kirk-Othmer Encyclopedia of Chemical Technology (3rd ed.), vol. 14, pp. 477-526 (pp. 495-499 attached).

U.S. Patent Application Ser. No. 7/210,454, filed Jun. 23, 1988.

*Primary Examiner*—Chung K. Pak

*Attorney, Agent, or Firm*—Alexander J. McKillop; Charles J. Speciale; L. G. Wise

[57] ABSTRACT

Compositions and methods of preparation for a lubricant mixture having enhanced viscosity index comprising:

(a) a low viscosity $C_{20}$–$C_{60}$ lubricant range liquid comprising substantially linear hydrocarbons prepared by shape selective catalysis of lower olefin with medium pore acid zeolite catalyst to provide substantially linear liquid olefinic intermediates or $C_{20}$+ hydrogenated lubricants, said lubricant range liquid having a kinematic viscosity of about 2–10 cS at 100° C.; and (b) at least one poly(alpha-olefin) having viscosity greater than 20 cS and viscosity index improvement properties.

27 Claims, No Drawings

SYNTHETIC POLYOLEFIN LUBRICANT BLENDS HAVING HIGH VISCOSITY INDICES

This invention relates to novel synthetic lubricant compositions exhibiting superior lubricant properties such as high viscosity index. More particularly, the invention relates to novel lubricant blends of oligomeric products of shape selective catalysis with other lubricants, such as high viscosity index polyalphaolefins lubricant basestock, conventional polyalphaolefins or other liquid lubricant basestock material.

BACKGROUND OF THE INVENTION

In zeolite catalyzed oligomerization of propylene or other lower olefins to produce high viscosity index (VI) lubricant range hydrocarbons in the $C_{20}$–$C_{60}$ range by shape selective catalysis, it has been observed that the average molecular weights of the tube products that give viscosities greater than 6 cS at 100° C. are not easily obtainable, due to diffusion limitation imposed by the medium pore catalyst structure. While these low cost lubricants can be made by the Mobil Olefins to Lubricants (MOL) process, it may be necessary to add viscosity improvers to obtain acceptable lubricant formulations. Synthetic hydrocarbon fluids have found increasing use as lubricant basestocks, additives and functional fluids. Automotive lubricants based on alpha-olefin oligomers have been commercially available for over a decade, preceded by many years of research to develop economic synthetic oils with improved viscosity index (VI), volatility, oxidation stability and lower temperature fluidity than naturally occurring mineral oils or those produced from refining of petroleum. Particular attention has been directed to upgrading low cost refinery olefins, such as $C_3$–$C_4$ byproducts of heavy oil cracking processes. Work by Garwood, Chen, Tabak and others has led to development of a useful process for producing lubricant range hydrocarbons by shape selective catalysis using medium pore ZSM-5 by the "MOL" (Mobil Olefins to Lubricants) process, described herein.

Synthetic poly-alpha-olefins (PAO), such as 1-decene oligomers, have found wide acceptability and commercial success in the lubricant field for their superiority to mineral oil based lubricants. In terms of lubricant properties improvement, industrial research effort on synthetic lubricants has led to PAO fluids exhibiting useful viscosities over a wide range of temperature, i.e., improved viscosity index (VI), while also showing lubricity, thermal and oxidative stability and pour point equal to or better than mineral oil. These relatively new synthetic lubricants lower mechanical friction, enhancing mechanical efficiency over the full spectrum of mechanical loads from worm gears to fraction drives and do so over a wider range of ambient operating conditions than mineral oil. The PAO's are prepared by the polymerization of 1-alkenes using typically Lewis acid or Ziegler-catalysts. Their preparation and properties are described by J. Brennan in Ind. Eng. Chem. Prod. Res. Dev. 1980, 19, pp 2–6, incorporated herein by reference in its entirety. PAO incorporating improved lubricant properties are also described by J. A. Brennan in U.S. Pat. Nos. 3,382,291, 3,742,082, and 3,769,363, incorporated herein by reference.

In accordance with customary practice in the lubricants art, PAO's have been blended with a variety of functional chemicals, oligomeric and high polymers and other synthetic and mineral oil based lubricants to confer or improve upon lubricant properties necessary for applications such as engine lubricants, hydraulic fluids, gear lubricants, etc. Blends and their components are described in Kirk-Othmer Encyclopedia of Chemical Technology, third edition, volume 14, pages 477–526, incorporated herein by reference. A particular goal in the formulation of blends is the enhancement of viscosity index (VI) by the addition of VI improvers which are typically high molecular weight synthetic organic molecules. While effective in improving viscosity index, these VI improvers have been found to be deficient in that their very property of high molecular weight that makes them useful as VI improvers also confers upon the blend a vunerability in shear stability during actual use applications. This deficiency dramatically negates the range of application usefulness for many VI improvers. Their usefulness is further compromised by cost since they are relatively expensive polymeric substances that may constitute a significant proportion of the final lubricant blend. Accordingly, workers in the lubricant arts continue to search for lubricant blends with high viscosity index less vulnerable to degradation by shearing forces in actual use applications while maintaining other important properties such as thermal and oxidative stability.

Recently, a novel class of PAO lubricant liquid compositions, herein referred to as "HVI-PAO", exhibiting surprisingly high viscosity indices has been reported in U.S. Pat. No. 4,827,073 which is a continuation in part of U.S. patent application Ser. No. 147,061, filed Jan. 22 1988, now abandoned, now abandoned in favor of U.S. Pat. Nos. 4,827,064 and 4,827,073, filed concurrently herewith, incorporated herein by reference. These novel PAO lubricants are particularly characterized by low ratio of methyl to methylene groups, i.e., low branch ratios, as further described hereinafter. Their very unique structure provides new opportunities for the formulation of distinctly superior and novel lubricant blends.

It is an object of the present invention to provide novel lubricant compositions having improved viscosity index and shear stability. It is a further object of the present invention to provide novel lubricant basestock blends from low viscosity synthetic MOL liquids and high viscosity PAO and HVI-PAO. In conjunction with a major amount of the MOL liquid hydrocarbons, the PAO additives provide excellent chemical and physical properties.

SUMMARY OF THE INVENTION

Compositions and methods of preparation have been discovered for a novel lubricant mixture having enhanced viscosity index. The preferred lubricants comprise: (a) a major amount of low viscosity $C_{20}$–$C_{60}$ lubricant range liquid comprising substantially linear hydrocarbons prepared by shape selective catalysis of lower olefin with medium pore acid zeolite catalyst to provide substantially linear liquid olefinic intermediates or $C_{20}$+ hydrogenated lubricants, said lubricant range having a kinematic viscosity of about 2–10 cS at 100° C.; and (b) a minor amount of at least one poly(alpha-olefin) having viscosity at least 20 cS at 100° C. and viscosity index improvement properties.

Lubricant mixtures having surprisingly enhanced viscosity indices have been discovered comprising hydrogenated oligomeric liquid products of shape selective catalysis in combination with various other lubricant basestock liquids and additives. Unexpectedly, when a low viscosity lubricant is blended with a high viscosity, high VI lubricant produced from alpha-olefins containing 6 to 20 carbon atoms, the resulting blends have high viscosity indices and low pour points. The blended materials may include HVI-PAO having a branch ratio of less than 0.19. The high viscosity index lubricant produced as a result of blending MOL liquids with HVI-PAO and/or PAO has much lower molecular weight than a conventional polymeric VI improver, thus offering the opportunity of greater shear stability.

The HVI-PAO having a branch ratio of less than 0.1 g employed to prepare the blends of the present invention may be comprised of hydrogenated $C_{30}H_{62}$ hydrocarbons.

DETAILED DESCRIPTION OF THE INVENTION

Preparation of MOL major basestock component

The MOL liquid lubricant range hydrocarbons may be prepared by the processes of Chen et al in U.S. Pat. Nos. 4,520,221 or 4,568,786, incorporated herein by reference. By upgrading propylene or butylenes to substantially linear hydrocarbons in contact with a medium pore shape selective zeolite catalyst, a low cost basestock is produced, suitable for blending with higher viscosity synthetic oils. The shape-selective oligomerization/polymerization catalysts preferred for use herein include the crystalline aluminosilicate zeolites having a silica to alumina molar ratio of at least 12, a constraint index of about 1 to 12 and acid cracking activity of about 50–300. Representative of the ZSM-5 type zeolites are ZSM-5, ZSM-11, ZSM-12, ZSM-Z23, ZSM-35 and ZSM-48. ZSM-5 is disclosed and claimed in U.S. Pat. No. 3,702,886 and U.S. Pat. No. Re. 29,948; ZSM-11 is disclosed and claimed in U.S. Pat. No. 3,709,979. Also, see U.S. Pat. No. 3,832,449 for ZSM-12; U.S. Pat. No. 4,076,812 for ZSM-Z3; U.S. Pat. No. 4,016,245 for ZSM-35. The disclosures of these patents are incorporated herein by reference. A suitable shape selective medium pore catalyst for fixed bed is a small crystal H-ZSM-5 zeolite (silica:alumina ratio=70:1) with alumina binder in the form of cylindrical extrudates of about 1–5 mm. Unless otherwise stated in this description, the catalyst shall consist essentially of ZSM-5, which has a crystallite size of about 0.02 to 0.05 micron. Other pentasil catalysts which may be used in one or more reactor stages include a variety of medium pore (i.e.-5 to 9A) siliceous materials such as gallosilicates, borosilicates, ferrosilicates, and/or aluminosilicates.

Optional secondary stage catalyst may comprise acid zeolites; however, other acid materials may be employed which catalyze ethylenic unsaturation reactions. Other desirable materials for the secondary reaction include HZSM-12, as disclosed in U.S. Pat. No. 4,254,295 (Tabak) or large-pore zeolites in U.S. Pat. No. 4,130,516 (LaPierre et al). Advantage may be obtained by selecting the same type of unmodified catalyst for both stages. Since the final stage is usually conducted at lower temperature than the initial reaction, higher activity may be maintained in the secondary reactor. However, the second stage catalyst can be any acid catalyst useful for polymerizing olefins. Particularly suitable are unmodified medium pore ZSM-5 type zeolites with a Constraint Index of 1–12, preferably of small crystal size (less than 1 micron). Also suitable are small pore zeolites, e.g., ZSM-34; large pore zeolites, e.g., mordenite, ZSM-4; synthetic faujasite; crystalline silica-aluminophosphates; amorphous silica-alumina; acid clays; organic cation exchange resins, such as cross linked sulfonated polystyrene; and Lewis acids, such as $BF_3$ or $AlCl_3$ containing suitable co-catalysts such as water, alcohols, carboxylic acids; or hydrogen halides.

Shape-selective oligomerization, as it applies to the conversion of $C_2$–$C_{10}$ olefins over ZSM-5, is known to produce higher olefins up to $C_{30}$ and higher. As reported by Garwood in Intrazeolite Chemistry 23, (Amer. Chem. Soc., 1983), reaction conditions favoring higher molecular weight product are low temperature (200°–260° C.), elevated pressure (about 2000 kPa or greater), and long contact time (less than 1 WHSV). The reaction under these conditions proceeds through the acid-catalyzed steps of (1) oligomerization, (2) isomerization-cracking to a mixture of intermediate carbon number olefins, and (3) interpolymerization to give a continuous boiling product containing all carbon numbers. The channel systems of ZSM-5 type catalysts impose shape-selective constraints on the configuration of the large molecules, accounting for the differences with other catalysts.

The desired oligomerization-polymerization products include $C_{20}+$ substantially linear aliphatic hydrocarbons. The ZSM-5 catalytic path for propylene feed provides a long chain with approximately one lower alkyl (e.g., methyl) substituent per 8 or more carbon atoms in the straight chain.

The hydrogenated lubricant range basestock product can be depicted as a typical linear molecule having a sparingly substituted (saturated) long carbon chain. The final molecular conformation is influenced by the pore structure of the catalyst. For the higher carbon numbers, the structure is primarily a methyl-branched straight olefinic chain, with the maximum cross section of the chain limited by the 5.4×5.6 Angstrom dimension of the largest ZSM-5 pore. Although emphasis is placed on the normal 1-alkenes as feed stocks, other lower olefins such as 2-butene or isobutylene, are readily employed as starting materials due to rapid isomerization over the acidic zeolite catalyst. At conditions chosen to maximize heavy distillate and lubricant range products ($C_{20}+$) the raw aliphatic product is essentially mono-olefinic. Overall branching is not extensive with most branches being methyl at about one branch per eight or more atoms.

The viscosity index of MOL hydrocarbon lube oil is related to its molecular conformation. Extensive branching in a molecule usually results in a low viscosity index. It is believed that two modes of oligomerization/polymerization of olefins can take place over acidic zeolites such as HZSM-5. One reaction sequence takes place at Brösted acid sites inside the channels or pores, producing essentially linear materials. The other reaction sequence occurs on the outer surface, producing highly branched material. By decreasing the surface acid activity of such zeolites, fewer highly branched products with low VI are obtained.

Several techniques may be used to increase the relative ratio of intra-crystalline acid sites to surface active sites. This ratio increases with crystal size due to geometric relationship between volume and superficial surface area. Deposition of carbonaceous materials by coke formation can also shift the effective ratio. However, enhanced effectiveness is observed where the surface acid sites of small crystal zeolites are reacted with a chemisorbed organic base or the like.

Catalysts of low surface activity can be obtained by using medium pore zeolites of small crystal size that have been deactivated by basic compounds, examples of which are amines, phosphines, phenols, polynuclear hydrocarbons, cationic dyes and others. These compounds have a minimum cross section diameter of 5 A or greater. Examples of suitable amines are described by Chen et al in U.S. Pat. No. 4,568,786.

The lower molecular weight $C_{10}$–$C_{20}$ intermediate materials formed over the modified catalyst are relatively linear olefins. These olefins can be effectively converted to lube range materials by additional polymerization. Accordingly, lube range materials can be obtained in accordance with the present invention in a two-stage process. Generally the first stage involves oligomerization of an inexpensive lower olefin of, e.g., propylene at about 200° C. over a surface poisoned HZSM-5. The second state involves further oligomerization/interpolymerization of the product (or a fraction of the product) from the first stage over a second and/or different acid catalyst, which may be modified or unmodified as disclosed herein, at about 100°–260° C. The temperature of the second stage is usually lower than that of the first stage, i.e., about 25°–75° C. lower and preferably the catalyst is an unmodified ZSM-5 type catalyst. Both high yields and high VI are achieved by this two-stage process.

Conventional temperatures, pressures and equipment may be used in the novel process disclosed herein. Preferred temperatures may vary from about 100 to about 350° C., preferably 150° to 250° C. pressures from about atmospheric to 20,000 kPa (3000 psi) and WHSV from about 0.01 to about 2.0, preferably 0.2 to 1.0 are employed.

EXAMPLE A

Stage I Processing

Primary stage catalyst (HZSM-5) is pretreated by mixing the catalyst particles with a 10 wt % solution of 2,6-di(t-butyl)-pyridine deactivating agent in hexane, solvent washing and drying to obtain a surface-deactivated material. An olefinic feedstock consisting of 27 weight percent propene, 36.1 wt. % butene, 10.7 wt. % propane and 26.1 wt. % butane is cofed with gasoline recycle in a downflow fixed bed reactor system, as depicted, at 7000 kPa (1000 psig), about 0.4 WHSV and average reactor temperature of 205° C. (400° F.). The deactivating agent is injected with the olefinic feed at a concentration of about 50 weight parts per million, based on fresh feed. The results of the continuous run are shown below.

TABLE I

| Primary Stage Production of Intermediate Hydrocarbon | | |
|---|---|---|
| Hours on Stream | 42–54 | 114–126 |
| Olefin Conv., wt. % | 98% | 98% |
| Yield, wt. % | | |
| LPG | 4 | 3 |
| Gasoline $C_5$-165° C. | 31 | 35 |
| Distillate (165–345° C.) | 58 | 57 |
| Lubricant range 345° C. | 7 | 5 |
| | 100% | 100% |
| Lube Properties | | |
| Viscosity @ 40° C., cS | 14.68 | 11.97 |
| Viscosity @ 100° C., cS | 3.60 | 3.13 |
| V.I. | 131 | 126 |

Stage II Processing

The secondary reactor is charged with unmodified HZSM-5 catalyst having an acid cracking activity (alpha-value) of about 250. An enclosed stirred reactor is maintained at an average temperature of about 175° C. under autogenous pressure. The secondary feed is the 165°–345° C. distillate cut from the primary effluent (Table I), which is contacted with catalyst at a 10:1 ratio based on active catalysts at a space velocity of about 0.1 to 0.4 WHSV. The results of this run are tabulated below:

TABLE II

| | | |
|---|---|---|
| Hours on Stream | 32–54 | 114–126 |
| Yield 650° F.+ Lube | 31.5 | 30.6 |
| Lube Properties | | |
| Viscosity, cS @ 40° C. | 22.49 | 21.75 |
| Viscosity, cS @ 100° C. | 4.50 | 4.48 |
| V.I. | 113 | 119 |

EXAMPLE B

Stage I

Ten parts by weight of 2,6-di-tert-butylpyridine modified small crystal (0.1 microns) HZSM-5 as prepared in Example A and 100 parts propylene are heated to 200° C. in an autoclave under inert atmosphere with stirring. After 15 hours, the pressure decreases from 1240 to 33 psi, 100 parts propylene are charged and the temperature is adjusted to 200° C. After 29.5 more hours, the pressure decreases from 1150 to 260 psi, 100 parts propylene are again charged and the temperature adjusted to 200° C. After 66.3 hours from the second propylene addition, the reaction is stopped. An oil product, 167.8 gm, was obtained which contained only 2.8% 650° F.+ lube fraction.

Stage II 162 parts by weight of the product from Stage I and 15 parts of unmodified small crystal HZSM-5 zeolite are chared to an autoclave. After flushing the contents with nitrogen, the mixture is heated carefully to 100° C., and maintained 4 days (96 hours). No significant change in the oil takes places as indicated by GC results of samples withdrawn from the reaction mixture. The temperature is raised to 150° C. After 69 hours at 150° C., the 650°F+ lube yield is determined to be 11.2%; after 92.7 hours, 16.7%; after 116.7 hours, 19.3%; after 140.8 hours, 23%; after 164.7 hours, 26.4%; after 236.7 hours, 31%. The reaction is stopped at this point and 138 gm product were recovered. After distillation, the 650° F.+ lube has kinematic viscosities of 31.1 cS at 40° C., 56 cS at 100° C and a VI of 120. The pour point is −20° F.

EXAMPLE C

Stage I

Oligomers are prepared as described in Example B and fractionated. The fraction containing $C_9$=-$C_{18}$= is used in the second stage to yield lube.

Stage II

One hundred parts of the $C_9$=-$C_{18}$= fraction from the first stage are cooled to 0°–5° C. in a stirred reactor under dry nitrogen atmosphere. The oligomer mixture is saturated with $BF_3$. To this $BF_3$-olefin mixture is added 10 ml of $BF_3$ $C_4H_9OH$ complex, keeping the temperature of the reaction mixture between 0°–5° C.

Samples are withdrawn periodically and their product compositions determined by gas chromatography. The results are tabulated below:

| Total Time Hours | % Conversion to Lube 650° F.+ | 750° F.+ |
|---|---|---|
| 0 | 0 | 0 |
| 0.5 | 20.6 | 12.1 |
| 1.0 | 28.0 | 17.5 |
| 2.0 | 32.5 | 20.9 |
| 3.0 | 35.8 | 23.6 |
| 4.0 | 36.9 | 24.4 |
| 5.0 | 39.2 | 26.3 |

After 5 hours, the reaction mixture is neutralized with ammonia to form a white solid which is filtered off. The lube is obtained by distillation. The 650° F.+ lube has kinematic viscosities of 32.82 cS at 40° C., 5.00 cS at 100° C. and a VI of 63.

EXAMPLE D

Stage I

Follows the procedure of Example C above.

Stage II

The procedure of Example C is followed, except that the reaction is carried out for 0.5 hours. The 650° F.+ lube (12%) has kinematic viscosities of 12.6 at 40° C., 3.2 cS at 100° C. and a VI of 127.

Examples C and D illustrate that lubes of high viscosities and of high viscosity index can be obtained when adequate reaction conditions are employed, such as by varying the total reaction time.

EXAMPLE E

Stage I

Fifteen parts by weight of large crystal HZSM-5 (1 micron) of relatively low surface acidity and 300 parts propylene are heated to 200° C. in autoclave under inert atmosphere with stirring. After 46 hours the chraged propylene is converted to $C_6$=(22.5%), $C_9$=(46.5%), $C_{12}$=(12.5), $C_{15}$=(5.5%), $C_{18}$=(4.0%), $C_{21}$=(3.5%) and $C_{21}$=(5.5%). This product mixture is used in the second stage reaction.

Stage II

Seventy parts of the total product from the first stage are heated over 7 parts of small crystal HZSM-5 (0.1 micron) under inert atmosphere at 150° C. The lube conversion is lube is accomplished in 180 hours. This lube has kinematic viscosities of 34.25 cS at 40° C., 5.85 cS at 100° C. and a VI of 113.

Various modifications can be made to the system, especially in the choice of equipment and non-critical processing steps.

EXAMPLE F

F.1 Preparation of MOL Lube From Propylene Using Two-Stage Process

Two fixed-bed reactors are used in series with a scrubber between. The first reactor, which has its own outlet and can be isolated from the rest of the system, is loaded with HZSM-5B extrudate catalyst, surface deactivated with 2,6-di(tert-butyl)pyridine (2,6-DTBP). The scrubber contains zeolite beta to remove any eluted 2,6-DTBP. The second reactor contains unmodified HZSM-5B extrudate. Propylene feed containing 100 ppm 2,6-DTBP is injected into the primary reactor, maintained at 800 psig and 230° C. to produce liquid product. Following scrubbing, the liquid is introduced to the second-stage reactor, maintained at 175° C. After reaching equilibrium-the-liquid products contain 35–40% 650° F.+ lube having a VI range of 115 to 135. After distillation and hydrogenation the lube products are useful for blending with high viscosity PAO basestock A.

F.2 Improvement of Viscosity and Viscosity Index (VI) of a Two-Stage Synthetic Propylene Lube by Blending With High Viscosity High VI Stock A Stock A is a commercial synthetic oil base stock prepared by acid oligomerization of 1-decene with $AlCl_3$ type Lewis acid catalyst. Blends of different ratios of F.1 two-stage MOL propylene lube and Stock A are prepared by carefully weighing and admixing the two components and viscosities and VI's as well as the pour points are determined by standard methods. The results are summarized in Table F.2.

TABLE F.2

Properties of Blends of a Two-Stage MOL Propylene Lube and Stock A

| Composition, % | | Viscosity, cS | | | |
|---|---|---|---|---|---|
| Two-Stage Lube | Stock A | 40° C. | 100° C. | VI | Pour, °C. |
| 100 | 0 | 25.55 | 4.95 | 119.7 | −45.7 |
| 95 | 5 | 31.51 | 5.84 | 130.2 | |
| 96.66 | 3.34 | | | | −47.0 |
| 90 | 10 | | | | −48.3 |
| 0 | 100 | 1242.75 | 100.75 | 170.2 | |

It is clearly shown that the viscosity, VI and pour point of the two-stage propylene lube have been improved by blending with minor amounts of Stock A.

F.3. Improvement of Viscosity and Viscosity Index (VI) of Two-Stage Synthetic Propylene Lubes by Blending With HVI-PAO Blends of different ratios of two different MOL two-stage propylene lubes and a HVI-PAO are prepared by admixing the two components. The viscosities and VI's are summarized in Table F.3.1 for one propylene lube and Table F.3.2 for the other.

F.3.1. The HVI-PAO is prepared by oligomerizing 1-decene with CrII catalyst as described herein to provide VI improver blending stock. The catalyst used for this synthesis is activated by calcining a 1% Cr on silica precursor (surface area=330 $m^2/g$ and pore volume=2.3 cc/g) at 700° C. with air for 16 hours and reduced with CO at 350° C. for one hour. The activated catalyst is stored and handled under nitrogen atmosphere.

The catalyst, 10 grams, is added to purified 1-decene, 2000 g, at 125° C. in a 4-liter flask blanked under NZ. The reaction mixture is stirred for 16 hours. The lube product is isolated at 90% yield by filtration to remove the solid catalyst and distillation to remove dimer at 120° C./0.1 mmHg. The lube product, after hydrogenation with Ni on Kieselguhr at 180° C. and 450 psi, have Viscosity at 100° C. of 131.5 cS and VI=213.

TABLE F.3.1

| Properties of Blends of a Two-Stage Propylene Lube and a HVI-PAO | | | | | |
|---|---|---|---|---|---|
| Composition, % | | Viscosity, cS | | | Pour, |
| Two-Stage Lube | HVI-PAO | 40° C. | 100° C. | VI | °C. |
| 100 | 0 | 25.89 | 4.92 | 114.4 | — |
| 98.0 | 2.0 | 28.16 | 5.28 | 121.5 | — |
| 94.8 | 5.2 | 30.87 | 5.73 | 129.0 | — |
| 89.8 | 10.2 | 36.96 | 6.74 | 141.3 | — |
| 80.0 | 20.0 | 52.82 | 9.23 | 157.8 | — |
| 60.0 | 40.0 | 225.89 | 32.73 | 190.5 | — |
| 40.0 | 60.0 | 228.04 | 32.48 | 187.6 | — |
| 0 | 100.0 | 1243.2 | 131.5 | 213.0 | −37 |

F.3.2. The HVI-PAO used in this example is prepared using a catalyst prepared similarly as previously described. The catalyst, 5 grams, is added to purified 1-decene heated to 100° C. After 16 hours reaction, the lube product isolated has viscosity at 100° C. of 324.86 cS and VI of 249. It is used in the blending experiment.

TABLE F.3.2

| Composition, % | | Viscosity, cS | | | |
|---|---|---|---|---|---|
| Two-Stage Lube | HVI-PAO | 40° C. | 100° C. | VI | Pour, °C. |
| 100 | 0.0 | 32.19 | 5.83 | 125.3 | −47 |
| 97.6 | 2.4 | 34.81 | 6.25 | 129.9 | −42 |
| 94.6 | 5.4 | 38.16 | 6.69 | 132.2 | −44 |
| 92.4 | 7.6 | 41.63 | 7.16 | 134.4 | −43 |
| 89.8 | 10.2 | 45.32 | 7.65 | 136.7 | −45 |
| 79.9 | 20.1 | 62.10 | 10.33 | 154.8 | −44 |

It is clearly shown that once two lubes of different viscosities and VI's are synthesized, a wide range of lube viscosities and VI's can be obtained simply by blending.

EXAMPLE G

G.1 Preparation of Lube From Propylene Using Single-Stage Process

This process is a modified MOL systhesis procedure. Milder conditions are used to form products essentially free of aromatics so as not to impart oxidative instability. A single fixed-bed tubular isothermal reactor and unmodified HZSM-5B are used. The temperature is maintained at 200° C. to 220° C. and the weight hourly space velocity is 0.25 to 0.5 WHSV, based on parts by weight of feed olefin per part of total catalyst. The 650° F. lube yield is 15–40%, with VI of about 90–105. All lube products are essentially free of aromatics as shown by NMR.

G.2 Blending of Single-Stage Propylene Lubes With HVI-PAO

The blending results are shown in Tables G.2 and G.3.

The HVI-PAO used in Table G.2 is the same as that used in Example F.3.1.

The HVI-PAO used in Table G.3 is the same as that in Example F.3.2.

TABLE G.2

| Properties of Blends of a Single-Stage Propylene Lube and a HVI-PAO | | | | |
|---|---|---|---|---|
| Composition, % | | Viscosity, cS | | |
| Single-Stage Lube | HVI-PAO | 40° C. | 100° C. | VI |
| 100 | 0 | 39.16 | 5.93 | 91.2 |
| 75.0 | 25.0 | 90.99 | 12.83 | 138.2 |
| 62.5 | 37.5 | 136.53 | 18.57 | 153.2 |

TABLE G.2-continued

| Properties of Blends of a Single-Stage Propylene Lube and a HVI-PAO | | | | |
|---|---|---|---|---|
| Composition, % | | Viscosity, cS | | |
| Single-Stage Lube | HVI-PAO | 40° C. | 100° C. | VI |
| 50.0 | 50.0 | 254.35 | 26.04 | 132.3 |
| 25.0 | 75.0 | 505.11 | 57.16 | 181.6 |
| 0 | 100.0 | — | 131.5 | 213.0 |

TABLE G.3

| Properties of Blends of a Single-Stage Propylene Lube and a HVI-PAO | | | |
|---|---|---|---|
| Composition, % | | Viscosity, cS | |
| Single-Stage Lube | HVI-PAO | 100° C. | VI |
| 100 | 0 | 4.01 | 93 |
| 87 | 13 | 7.9 | 143 |
| 74 | 26 | 13.8 | 165 |

EXAMPLE H.1

A commercial Cr on silica catalyst which contains 1% Cr on a large pore volume synthetic silica gel is used. The catalyst is first calcined with air at 700° C. for 16 hours and reduced with CO at 350° C. for one to two hours. 1.0 part by weight of the activated catalyst is added to 1-decene of 200 parts by weight in a suitable reactor and heated to 185° C. 1-Decene is continuously fed to the reactor at 2–3.5 parts/minute and 0.5 parts by weight of catalyst is added for every 100 parts of 1-decene feed. After 1200 parts of 1-decene and 6 parts of catalyst are charged, the slurry is stirred for 8 hours. The catalyst is filtered and light product boiled below 150° C. @ 0.1 mm Hg is stripped. The residual product is hydrogenated with a Ni on Kieselguhr catalyst at 200° C. The finished product has a viscosity at 100° C. of 18.5 cs, VI of 165 and pour point of −55° C.

EXAMPLE H.2

The proceduce of Example H.1 is followed, except reaction temperature is 185° C. The finished product has a viscosity at 100° C. of 145 cs, VI of 214, pour point of −40° C.

EXAMPLE H.3

The procedure of Example H.1 is followed, except reaction temperature is 100° C. The finished product has a viscosity at 100° C. of 298 cs, VI of 246 and pour point of −32° C.

The final lube products in Examples H.1–H.3 contain the following amounts of dimer and trimer and isomeric distribution (distr.).

TABLE H

| Example | H.1 | H.2 | H.3 |
|---|---|---|---|
| Vcs @ 100° C. | 18.5 | 145 | 298 |
| VI | 165 | 214 | 246 |
| Pour Point, °C. | −55° C. | −40 ° C. | −32 |
| wt % dimer | 0.01 | 0.01 | 0.027 |
| wt % isomeric distr. dimer | | | |
| n-eicosane | 51% | 28% | 73% |
| 9-methylnonacosane | 49% | 72% | 27% |
| wt % trimer | 5.53 | 0.79 | 0.27 |
| wt % isomeric distr. trimer | | | |
| 11-octyldocosane | 55 | 48 | 44 |
| 9-methyl,11-octyl-heneicosane | 35 | 49 | 40 |
| others | 10 | 13 | 16 |

These three examples demonstrate that the new HVI-PAO of wide viscosities contain the dimer and trimer of unique structures in various proportions. The molecular weights and molecular weight distributions are analyzed by a high pressure liquid chromatography, composed of a Constametric II high pressure, dual piston pump from Milton Roy Co. and a Tracor 945 LC detector. During analysis, the system pressure is 650 psi and THF solvent (HPLC grade) deliver rate is 1 cc per minute. The detector block temperature is set at 145° C. 50 microliter of sample, prepared by dissolving 1 gram PAO sample in 100 cc THF solvent, is injected into the chromatograph. The sample is eluted over the following columns in series, all from Waters Associates: Utrastyragel $10^5$ A, P/N 10574, Utrastyragel $10^4$ A, P/N 10573, Utrastyragel $10^3$ A, P/N 1057Z, Utrastyragel 500 A, P/N 10571. The molecular weights are calibrated against commercially available PAO from Mobil Chemical Co, Mobil SHF-61 and SHF-81 and SHF-401.

The following table summarizes the molecular weights and distributions of Examples H.1 to H.3.

| Example | H.1 | H.2 | H.3 |
|---|---|---|---|
| V @ 100° C., cs | 18.5 | 145 | 298 |
| VI | 165 | 214 | 246 |
| number-averaged molecular weights, $MW_n$ | 1670 | 2062 | 5990 |
| weight-averaged molecular weights, $MW_{\#w}$ | 2420 | 4411 | 13290 |
| molecular weight distribution, MWD | 1.45 | 2.14 | 2.22 |

Under similar conditions, HVI-PAO product with viscosity as low as 3 cs and as high as 750 cs, with VI between 130 and 280, can be produced. The use of supported Group VIB oxides as a catalyst to oligomerize olefins to produce low branch ratio lube products with low pour points was heretofore unknown. The catalytic production of oligomers with structures having a low branch ratio which does not use a corrosive co-catalyst and produces a lube with a wide range of viscosities and good V.I.'s was also heretofore unknown and more specifically the preparation of lube oils having a branch ratio of less than about 0.19 was also unknown heretofore.

Pour point and cloud point data for the above examples H.1 and H.3 respectively are given in Table H.4 and H.5 below:

TABLE H.4

Properties of Blends of a Single-Stage Propylene Lube and a HVI-PAO

| Composition, % | | | | | | |
|---|---|---|---|---|---|---|
| Single-Stage Lube | HVI-PAO | Viscosity, cS 40° C. | Viscosity, cS 100° C. | VI | Pour, °C. Point | Cloud °C. Point |
| 100 | 0 | 28.08 | 4.88 | 93.0 | −43.4 | −28.9 |
| 95 | 5 | 35.50 | 6.05 | 116.2 | −44.5 | — |
| 90 | 10 | 48.02 | 7.95 | 136.3 | −45.0 | −55.0 |
| 80 | 20 | 70.39 | 11.26 | 152.6 | −45.0 | −54.8 |
| 0 | 100 | 3120.0 | 295.0 | 245.0 | −32.0 | — |

TABLE H.5

Properties of Blends of a Single-Stage Propylene Lube and a HVI-PAO

| Composition, % | | | | | | |
|---|---|---|---|---|---|---|
| Single-Stage Lube | HVI-PAO | Viscosity, cS 40° C. | Viscosity, cS 100° C. | VI | Pour, °C. | Cloud °C. |
| 100 | 0 | 28.08 | 4.88 | 93.0 | −43.4 | −28.9 |
| 95 | 5 | 34.11 | 5.79 | 110.9 | −45.0 | — |
| 90 | 10 | 40.97 | 6.71 | 118.7 | −45.0 | — |
| 84.5 | 15.5 | 47.6 | 7.80 | 132.5 | −45.4 | −55.0 |
| 80 | 20 | 59.45 | 9.51 | 142.5 | −44.5 | — |
| 0 | 100 | 1418.0 | 145.0 | 215.0 | −40 | — |

Blending Techniques

The synthetic lubricant blending basestocks of the instant invention are obtained by mixing a major amount of low viscosity MOL lubricant basestock with conventional higher viscosity PAO materials, including conventional Lewis acid catalyzed oligomers and/or HVI-PAO having a very high viscosity index. The low viscosity lubricant basestock, typically with a viscosity of about 2 to 10 cS at 100° C., can be synthetic MOL, and/or other synthetic lube stock. The high viscosity PAO lubricant basestock, typically with a viscosity of 20 to 1000 cS at 100° C. are produced from alpha-olefins, 1-alkenes, of $C_6$ to $C_{20}$, either alone or in mixture. The high viscosity, high VI basestock, HVI-PAO, is further characterized by having a branch ratio of less than 0.19. When the high viscosity PAO basestock is blended with MOL lubricant basestock of low viscostiy, the resultant lubricant has an unexpectedly high viscosity index and low pour points. The PAO is oxidatively and hydrolytically stable, as compared to other V.I. improvers.

The PAO lubricant blending stock of the present invention may be prepared by the oligomerization of 1-alkenes as described hereinafter, wherein the 1-alkenes have 6 to 20 carbon atoms to give a viscosity range of 20–1000 cS at 100° C. The oligomers may be homopolymers or copolymers of such $C_6$–$C_{20}$ 1-alkenes, or physical mixtures of homopolymers and copolymers. They are preferably homopolymers of 1-decene or mixtures of 1-alkenes having 8 to 12 carbon atoms, characterized by their branch ratio of less than 0.19 and are further characterized as having a number average molecular weight range from 300 to 30,000.

Other useful minor blending components include hydrogenated polyolefins as polyisobutylene and polypropylene and the like. Such polymers may include compositions exhibiting useful lubricant properties or conferring dispersant, anticorrosive or other properties on the blend.

Compositions according to the present invention may be formulated according to known lube blending techniques to combine HVI-PAO components with various phenates, sulphonates, succinamides, esters, polymeric VI improvers, ashless dispersants, ashless and metallic detergents, extreme pressure and antiwear additives, antioxidants, corrosion inhibitors, anti-rust inhibitors, emulsifiers, pour point depressants, defoamants, biocides, friction reducers, anti-stain compounds, etc.

Unless otherwise noted, MOL, PAO and other lubricants discussed herein refer to hydrogenated materials in keeping with the practice of lubricant preparation well known to those skilled in the art.

Sometimes, the oligomeric MOL and PAO, obtained from the individual oligomerization reactions, can be blended together first and then hydrogenate the blend to produce a finished basestock useful for engine oil or industrial oil basestocks.

The following examples illustrate the application of the instant invention in the preparation of HVI-PAO viscosity index improver suitable for mixing with MOL. Blending experiment have the following viscometric properties:

EXAMPLE J

A Cr (1wt %) on silica catalyst, 4 grams, calcined at 600° C. with air and reduced with CO at 350° C., is mixed with 1-decene, 63 grams in a flask. The mixture is heated in an 100° C. oil bath under $N_2$ atmosphere for 16 hours. The lube product is obtained by filtration to remove catalyst and distilled to remove components boiling below 120° C. at 0.1 mmHg. The $C_{30}$+ lube product yield is 92%.

EXAMPLE K

Example J is repeated except 1.7 grams of catalyst and 76 grams of 1-decene are heated to 125° C. The lube yield is 86%.

EXAMPLE L

Activated Cr (1 wt %) on silica catalyst, 3 grams, calcined at 500° C. with air and reduced with CO at 350° C., is packed in a stainless steel tubular reactor and heated to 119±3° C. 1-Decene is fed through this reactor at 15.3 grams per hour at 200 psig. After about 2 hours on stream, 27.3 grams of crude product is collected. After distillation, 19 grams of lube product is obtained.

EXAMPLE M

In the same run as the previous example, 108 grams of crude is obtained after 15.5 hours on stream. After distillation, 86 grams of lube product is obtained

EXAMPLE N

N.1 Catalyst Preparation and Activation Procedure 1.9 grams of chromium (II) acetate ($Cr_2(OCOCH_3)_4.2H_2O$) 5.58 mmole) (commercially obtained) is dissolved in 50 cc of hot acetic acid. Then 50 grams of a silica gel of 8–12 mesh size, a surface area of 300 $m^2/g$, and a pore volume of 1 cc/g, also is added. Most of the solution is absorbed by the silica gel. The final mixture is mixed for half an hour on a rotavap at room temperature and dried in an open-dish at room temperature. First, the dry solid (20 g) is purged with $N_2$ at 250° C. in a tube furnace. The furnace temperature is then raised to 400° C. for 2 hours. The temperature was then set at 600° C. with dry air purging for 16 hours. At this time the catalyst is cooled under $N_2$ to a temperature of 300° C., and a stream of pure CO (99.99% from Matheson) is introduced for one hour. Finally, the catalyst is cooled down to room temperature under $N_2$ and ready for use.

Example N.2

The catalyst prepared in Example N.1(3.2 g ) is packed in a stainless steel tubular reactor inside an $N_2$ blanketed dry box. The reactor under $N_2$ atmosphere is then heated to 150° C. by a single-zone Lindberg furnace. Pre-purified 1-hexene is pumped into the reactor at 140 psi and 20 cc/hr. The liquid effluent is collected and stripped of the unreacted starting material and the low boiling material at 0.05 mm Hg. The residual clear, colorless liquid has viscosities and VI's suitable as a lubricant base stock.

| Sample | Prerun | N.2.1 | N.2.2 | N.3 |
|---|---|---|---|---|
| Time, hr. | 2 | 3.5 | 5.5 | 21.5 |
| Lube Yield, wt % | 10 | 41 | 74 | 31 |
| Viscosity, cS, at | | | | |
| 40° C. | 208.5 | 123.3 | 104.4 | 166.2 |
| 100° C. | 26.1 | 17.1 | 14.5 | 20.4 |
| VI | 159 | 151 | 142 | 143 |

EXAMPLE O

Similar to Example N, a fresh catalyst sample is charged into the reactor and 1-hexene is pumped to the reactor at 1 atm and 10 cc per hour. As shown below, a lube of high viscosities and high VI's was obtained. These runs show that at different reaction conditions, a lube product of high viscosities can be obtained.

| Sample | 0.1 | 0.2 |
|---|---|---|
| .T.O.S., hrs | 20 | 44 |
| Temp., ° C. | 100 | 50 |
| Lube Yield, % | 8.2 | 8.0 |
| Viscosities, cS at | | |
| 40° C. | 13170 | 19011 |
| 100° C. | 620 | 1048 |
| VI | 217 | 263 |

EXAMPLE P

A commercially available standard chrome/silica catalyst which contains 1% Cr on a large-pore volume synthetic silica gel is first calcined with air at 800° C. for 16 hours and reduced with CO at 300° C. for 1.5 hours. Then 3.5 g of the catalyst is packed into a tubular reactor and heated to 100° C. under the $N_2$ atmosphere. 1-Hexene is pumped through at 28 cc per hour at 1 atmosphere. The products were collected and analyzed as follows:

| Sample | P.1 | P.2 | P.3 | P.4 |
|---|---|---|---|---|
| Time, hrs. | 3.5 | 4.5 | 6.5 | 12.5 |
| Lube Yield, % | 73 | 64 | 59 | 21 |
| Viscosity, cS, at | | | | |
| 40° C. | 2548 | 2429 | 3315 | 9031 |
| 100° C. | 102 | 151 | 197 | 437 |
| VI | 108 | 164 | 174 | 199 |

These runs show that different Cr on a silica catalyst were also effective for oligomerizing olefins to lube products.

EXAMPLE Q

As in Example P, purified 1-decene is pumped through the reactor at 250 to 320 psi. The product is collected periodically and stripped of light products boiling points below 650° F. High quality lubes with high VI are obtained (see following table).

| Reaction Temp. °C. | WHSV g/g/hr | Lube Product Properties V at 40° C. cS | V at 100° C. cS | VI |
|---|---|---|---|---|
| 120 | 2.5 | 1555.4 | 157.6 | 217 |
| 135 | 0.6 | 389.4 | 53.0 | 202 |
| 150 | 1.2 | 266.8 | 36.2 | 185 |
| 166 | 0.6 | 67.7 | 12.3 | 181 |
| 197 | 0.5 | 21.6 | 5.1 | 172 |

EXAMPLE R

Similar catalyst is used in testing 1-hexene oligomerization at different temperature. 1-Hexene is fed at 28 cc/hr and at 1 atmosphere.

| Sample | R.1 | R.2 |
|---|---|---|
| Temperature, °C. | 110 | 200 |
| Lube Yield, wt. % | 46 | 3 |
| Viscosities, cS at | | |
| 40° C. | 3512 | 3760 |
| 100° C. | 206 | 47 |
| VI | 174 | 185 |

EXAMPLE S 1.5 grams of a similar catalyst as prepared in Example Q is added to a two-neck flask under $N_2$ atmosphere. Then 25 g of 1-hexene is added. The slurry is heated to 55° C. under $N_2$ atmosphere for 2 hours. Then some heptane solvent is added and the catalyst was removed by filtration. The solvent and unreacted starting material was stripped off to give a viscous liquid with a 61% yield. This viscous liquid had viscosities of 1536 and 51821 cS at 100° C. and 40° C., respectively. This example demonstrates that the reaction can be carried out in a batch operation.

The MOL approach to synthetic lubricant preparation involves upgrading low cost $C_3/C_4$ olefins by shape selective zeolite catalysis in one or more steps. The preferred PAO viscosity improvers are prepared by oligomerization of 1-decene $BP_3/AlCl_3$ Lewis acid catalysts or over Cr(II). It may be desirable to combine aspects or processes for preparing the MOL liquids (e.g., $C_{30}+$ hydrocarbons) and further upgrading these by acid or Cr catalyst, for instance with addition of small amounts (0–10%) of 1-decene to a reaction mixture containing a portion of MOL liquids having terminal unsaturation. This approach can prove valuable in producing low cost mixtures of $C_{30}+$ oligomers by combination of two or more sequential catalytic process steps.

EXAMPLE T

Olefinic MOL liquid having an initial viscosity ($V_{40}$) of 3.16 cS, is further upgraded a series of runs by contacting the liquid material with the CrII/silica catalyst described above at 125° C.

Run T.1 is conducted for 44 hours at a feed:catalyst weight ratio of 20:1 to yield a product visosity increase to 3.15. Run T.2 repeats T.1 for 116 hours, yielding product upgraded to $V_{40}$ of 3.85, $V_{100}$ of 1.41 and VI=90.

Run T.3 repeats T.2 to yield product viscosity $V=_{40}=4.34$, $V_{100}=1.53$ and VI=92. It is believed that increasing terminal olefin concentation by metathesis can further upgrade MOL liquids in situ by CrII catalysis.

While the invention has been described by preferred examples, there is no intent to limit the inventive concept except as set forth in the following claims.

What is claimed is:

1. A multi-stage process producing synthetic lubricant hydrocarbons by oligomerizing lower olefin feed at elevated temperature and pressure which comprises contacting the lower olefin in a primary reactor stage under oligomerization conditions with a medium pore shape-selective siliceous zeolite catalyst having acid cracking activity to produce a substantially linear olefin, intermediate-range hydrocarbon;

contacting at least a portion of the primary stage effluent in a secondary reactor stage with an acid catalyst to produce a lubricant range hydrocarbon basestock having kinematic viscosity of about 2 to 6 cS at 100° C.;

hydrogenating at least a portion of said hydrocarbon basestock; and blending the hydrogenated basestock with at least one other hydrogenated lubricant range synthetic poly(alpha-olefin) having a kinematic viscosity of at least 20 cS to provide a lubricant blend composition, wherein said poly(alpha-olefin) has a branch ratio less than 0.19, a number average molecular weight of about 300 to 30,000, weight average molecular weight between 300 and 150,000, molecular weight distribution between 1.00 and 5, viscosity index greater than 130 and pour point below −15° C.

2. The process of claim 1 wherein the zeolite consists essentially of aluminosilicate HZSM-5 having a silica to alumina molar ratio at least 12, having the zeolite surface acidity neutralized.

3. The process of claim 1 including the step of separating the primary stage effluent to obtain a heavy fraction rich in substantially linear $C_{10}+$ olefins; and wherein a light fraction is recovered from the primary stage effluent for recycle and conversion with the lower olefin feed.

4. The process of claim 1 wherein the primary stage is operated continuously in a series of fixed bed downflow reactors by adding a sterically-hindered nitrogenous base to lower olefin feed at a rate sufficient to maintain surface inactivity in the catalyst.

5. The process of claim 1 wherein 2, 6-di(t-butyl)-pyridine is injected into the feed at a concentration of about 5 to 1000 ppm, and wherein the secondary stage acid catalyst comprises $BF_3$.

6. The process of claim 4 wherein the catalyst is pretreated with a surface-deactivating amount of the base and is essentially free of carbonaceous deposits.

7. The process of claim 4 wherein both stages contain HZSM-5 catalyst and are operated continuously; and further comprising the steps of: contacting the primary stage heavy effluent fraction with an adsorbent between stages to remove any residual nitrogenous base; and maintaining the secondary stage at an average temperature less than about 260° C. at elevated pressure greater than about 2000 kPa and weight hourly space velocity less than 1 $hr^{-1}$.

8. The process of claim 1 wherein the olefinic feed consists essentially of $C_3$–$C_4$ aliphatics; the catalyst consists essentially of a fixed bed of HZSM-5 particles having an acid cracking value prior to deactivation treatment of about 50 to 300, and the process is conducted at a temperature of about 150° C. to 290° C., a pressure of at least about 1500 kPA and weight hourly space velocity of about 0.1 to 2 $hr^{-1}$.

9. The process of claim 1 wherein said number average molecular weight is between 300 and 20,000, said weight average molecular weight is between 330 and 60,000 and said molecular weight distribution is between 1.01 and 3.

10. The process of claim 1 wherein said hydrogenated poly(alpha-olefin) comprises the hydrogenated polymeric or copolymeric residue of $C_6$ to $C_{20}$ 1-alkenes.

11. The process of claim 1 wherein said poly(alpha-olefin) comprises polydecene, and wherein said polydecene has a VI greater than 130 and a pour point below −15° C.

12. The process of claim 1 wherein said mixture comprises between 1 and 99 weight percent of said polyalpha-olefin with a kinematic viscosity at 100° C. of between 20 and 1000 centistokes in amount sufficient to impart improved thermal and shear stability, oxidative stability and substantially increased viscosity index.

13. The process of claim 1 wherein said poly(alpha-olefin) has a kinematic viscosity of at least 20 cS and comprises about 5 to about 20 weight percent of said mixture.

14. The process of claim 1 wherein said hydrogenated polyalpha-olefin is the oligomerization product of the oligomerization of 1-alkene in contact with reduced chromium oxide catalyst supported on silica.

15. The process of claim 14 wherein said 1-alkene consists essentially of 1-decene and wherein said lower olefin comprises propene or butene.

16. A process for producing lubricant hydrocarbons by oligomerizing lower olefin feed at elevated temperature and pressure which comprises contacting the lower olefin under oligomerization conditions with a medium pore shape-selective siliceous zeolite catalyst having acid catalyst activity to produce an olefinic, substantially linear $C_{20}$ lubricant range hydrocarbon having kinematic viscosity of about 2 to 10 cS at 100° C.;

hydrogenating at least a portion of said hydrocarbon basestock; and blending a major amount of the hydrogenated basestock with about 5 to 20 weight percent of at least one other lubricant range synthetic polyolefin having a kinematic viscosity of at least 20 cS, a branch ratio less than 0.19, viscosity index greater than 130 and pour point below −15° C. to provide a lubricant blend composition having improved viscosity index.

17. A multi-stage process for producing lubricant hydrocarbons comprising the steps of:

oligomerizing lower olefinic feed containing propylene or butylene at elevated temperature and pressure in a primary reactor stage under oligomerization conditions with a medium pore, shape-selective acid zeolite catalyst to produce a substantially linear olefinic, intermediate-range hydrocarbon;

contacting at least a portion of intermediate range hydrocarbon in a secondary reactor stage with an acid catalyst to produce a $C_{20}$–$C_{60}$ hydrocarbon lubricant basestock having kinematic viscosity of about 2 to 6 cS at 100° C.;

oligomerizing 1-decene in contact with reduced chromium oxide catalyst on a porous support to produce a polydecene lubricant range synthetic viscosity improving additive having a branch ration less than 0.19 and having a kinematic viscosity of at least 20 cS at 100° C.;

hydrogenating said $C_{20}$–$C_{60}$ hydrocarbon lubricant basestock and said polydecene additive; and blending a major amount of the hydrogenated $C_{20}$–$C_{60}$ hydrocarbon lubricant basestock with a minor amount of the hydrogenated polydecene to provide a lubricant blend composition having improved viscosity index and enhanced shear stability.

18. The process of claim 17 wherein the zeolite consists essentially of aluminosilicate HZSM-5 having a silica to alumina molar ratio at least 12, having the zeolite surface acidity neutralized.

19. The process of claim 17 wherein 2,6-di(t-butyl)-pyridine is injected into primary stage feed at a concentration of about 5 to 1000 ppm, and wherein the secondary stage acid catalyst comprises $BF_3$.

20. The process of claim 17 whereas said polydecene has a number average molecular weight of about 300 to 30,000, weight average molecular weight between 300 and 150,000, molecular weight distribution between 1.00 and 5, viscosity index greater than 130 and pour point below −15° C.

21. A multi-stage process for producing synthetic lubricant hydrocarbons by oligomerizing lower olefin feed at elevated temperature and pressure which comprises (a) contacting the lower olefin in a primary reactor stage under oligomerization conditions with medium pore shape-selective siliceous zeolite catalyst having acid catalyst activity to produce a substantially linear olefinic, intermediate-range hydrocarbon;

(b) contacting at least a portion of the primary stage effluent in a secondary reactor stage with an acid catalyst to produce a lubricant range hydrocarbon basestock having kinematic viscosity of about 2 to 6 cS at lower 100° C.;

(c) hydrogenating at least a portion of said hydrocarbon basestock;

(d) oligomerizing at least one $C_6$–$C_{20}$ alpha-olefin with reduced chromium oxide catalyst and then hydrogenating the oligomerized product to produce poly(alphaolefin) having a kinematic viscosity of at least 20 cS;

(e) blending basestock from step (c) with at least one other hydrogenated lubricant range synthetic poly-(alpha-olefin) from step (d) in an amount sufficient to provide a lubricant blend composition having enhanced viscosity index and shear stability properties.

22. The process of claim 21 wherein said poly(alpha-olefin) has a branch ratio less than 0.19, a number average molecular weight of about 300 to 30,000, weight average molecular weight between 300 and 150,000, molecular weight distribution between 1.00 and 5, viscosity index greater than 130 and pour point below −15° C.

23. A process for producing lubricant hydrocarbons which comprises:

(a) contacting $C_3$–$C_4$ olefin under oligomerization conditions with a medium pore shape-selective siliceous zeolite catalyst having acid catalyst activity to produce an olefinic, substantially linear $C_{20}$+ lubricant range hydrocarbon having kinematic viscosity of about 2 to 10 cS at 100° C.;

(b) hydrogenating at least a portion of said hydrocarbon basestock;

(c) oligomerizing alpha-decene with reduced chromium oxide catalyst to produce liquid poly(alpha-decene) having a kinematic viscosity of at least 20 cS and branch ratio less than 0.19; and (d) blending a major amount of said hydrogenated basestock with about 5 to 20 weight percent of said poly(alpha-decene) to provide a lubricant blend composition having improved viscosity index.

24. The process of claim 23 wherein siad poly(alpha-decene) has a VI greater than 130 and a pour point below −15° C.

25. The process of claim 23 wherein the lubricant blend contains about 5 to 20 weight percent of poly(alpha-decene) with a kinematic viscosity at 100° C. between 20 and 1000 centistokes in amount sufficient to impart improved thermal and shear stability, oxidative stability and substantially increased viscosity index.

26. The process of claim 23 wherein the zeolite consists essentially of aluminosilicate HZSM-5 having a silica to alumina molar ratio at least 12, having the zeolite surface acidity neutralized.

27. The process of claim 23 wherein said polydecene has a number average molecular weight of about 300 to 30,000, weight average molecular weight between 300 and 150,000, molecular weight distribution between 1.00 and 5, viscosity index greater than 130 and pour point below −15° C.

* * * * *